US006182291B1

(12) United States Patent
Garvey

(10) Patent No.: US 6,182,291 B1
(45) Date of Patent: Feb. 6, 2001

(54) HUNTING VEST HAVING REVERSIBLE FLAPS

(76) Inventor: John Garvey, 1196 Blockville Watts Flats Rd., Ashville, NY (US) 14710

( * ) Notice: Under 35 U.S.C. 154(b), the term of this patent shall be extended for 0 days.

(21) Appl. No.: 09/409,269

(22) Filed: Sep. 30, 1999

(51) Int. Cl.[7] ..... A41D 1/04
(52) U.S. Cl. ..... 2/102; 2/69
(58) Field of Search ..... 2/247, 102, 69, 2/94, 85, 93, 115, 108

(56) References Cited

U.S. PATENT DOCUMENTS

| | | | | |
|---|---|---|---|---|
| D. 269,136 | | 5/1983 | Pressentin . | |
| D. 270,585 | | 9/1983 | Viio . | |
| D. 278,089 | | 3/1985 | Day . | |
| D. 299,680 | | 2/1989 | Ochsner . | |
| 1,773,442 | * | 8/1930 | Speh | 2/93 |
| 1,879,341 | | 9/1932 | Lapham . | |
| 2,685,690 | * | 8/1954 | Chrisman | 2/1 |
| 3,337,101 | * | 8/1967 | Tombari | 224/14 |
| 3,774,240 | | 11/1973 | Johnson . | |
| 3,885,248 | | 5/1975 | Salsby . | |
| 4,277,848 | * | 7/1981 | Boehland | 2/115 |
| 4,472,835 | | 9/1984 | Clark . | |
| 4,625,337 | * | 12/1986 | Zahn | 2/82 |
| 4,669,127 | * | 6/1987 | Swanson | 2/46 |
| 4,796,304 | | 1/1989 | Shelby . | |
| 5,063,614 | * | 11/1991 | McSheffery | 2/94 |
| 5,159,718 | * | 11/1992 | Moyer | 2/69 |
| 5,274,848 | * | 1/1994 | Shamblin | 2/69 |
| 5,278,998 | * | 1/1994 | Book | 2/102 |
| 5,361,412 | | 11/1994 | Perry . | |
| 5,718,000 | * | 2/1998 | Ost et al. | 2/69 |

* cited by examiner

*Primary Examiner*—Gloria M. Hale
*Assistant Examiner*—Tejash Patel
(74) *Attorney, Agent, or Firm*—The Bilicki Law Firm, P.C.

(57) ABSTRACT

The invention is a hunting vest that is comprised of a base fabric material. Flaps are provided on the front and on the back of the vest. The flaps have a camouflage color on one side, and a blaze orange color on the opposite side. The flaps are detachably attached to the vest so that either color is visible, dependent on the choice of the hunter. The front flap is designed to fold over pockets, designed to protect shotgun shells, in the front side of the vest. The vest can also be equipped with additional pockets and a game bag.

3 Claims, 5 Drawing Sheets

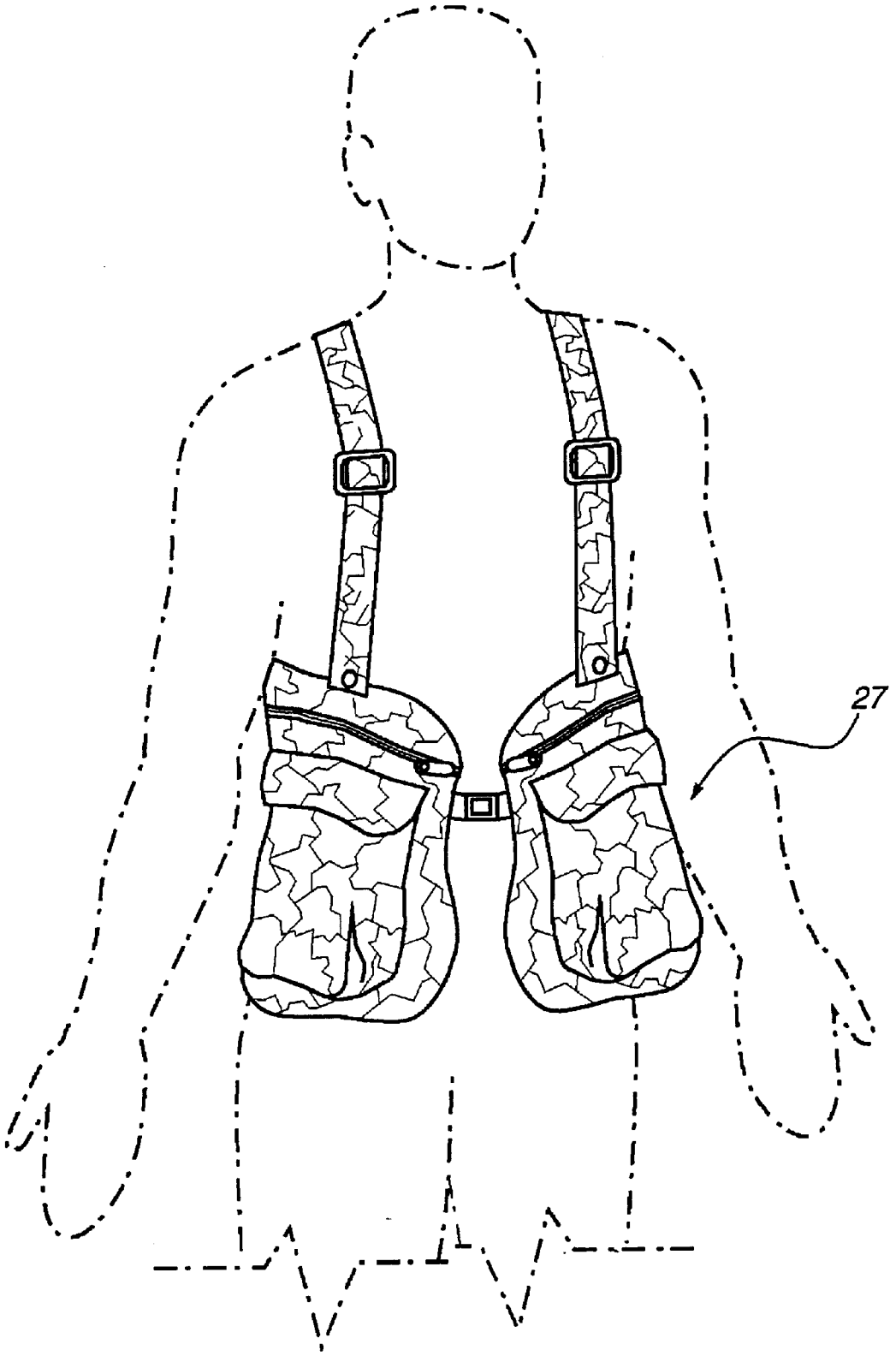
GAME BAG
(FIG. 5)

HUNTING VEST HAVING REVERSIBLE FLAPS

TECHNICAL FIELD

This invention relates to clothing, and in particular to hunting clothing. More specifically, this invention relates to hunting vests that have colored reversible flaps on the front and back of the vest.

BACKGROUND ART

In order to remain concealed from animals while hunting, hunters typically wear camouflage clothing. However, there are times during the same hunting excursion that hunters wish to be visible while walking through the woods so that the hunter is visible to other hunters, such as when the hunter is walking through the hunting area. Presently, this requires the hunter to carry two different garments on their person while hunting. The first garment is the camouflage clothing while the second garment is some brightly colored garment to promote visibility. This invention provides for an improvement to common hunting vests in which the one vest can be modified without removing the vest to change its color.

Inventors have obtained patents on hunting vests that provide beneficial features. For instance, U.S. Pat. No. 4,796,304 (Shelby) provides for ventilated pockets composed of a netting material in front of a base fabric material. The ventilated pockets allow for air to ventilate food and other items that would otherwise become stale or soggy in non-ventilated pockets.

U.S. Pat. No. 3,885,248 (Salsby) includes a hunting vest that has an elongated back panel to prevent blood from a gutted carcass from splashing on the hunter during transportation of the carcass from the woods.

U.S. Pat. No. 3,337,101 (Tombari) discloses a hunting vest that has pockets on the outside for the storage of shells, cartridges, or other relatively heavy articles. These pockets allow for a hunter to readily and quickly retrieve the articles when needed.

U.S. Pat. No. Des. 278,089 (Day) is a design patent for a reversible vest. This patent discloses a vest that can be turned inside out. The vest has pockets on one side of the vest only. Thus, when the user reverses the vest, the pockets become inaccessible by the wearer.

These vests are limited in that none provide a hunting vest that can be modified in the woods by the hunter to change the color of the vest without removing the vest. Further, none of these vests allow for the hunter to change the color of the vest without disrupting the orientation of the pockets or the items carried in the pockets of the vest.

There is a need for a hunting vest that is capable of being modified so that the color of the vest is changed without removing the vest from the person. There is a need for doing this modification quickly and easily by the hunter, while in the woods, without having to carry or store extra clothing on their person. There is also a further need for performing such modification without disrupting the orientation of items in pockets of the hunting vest. Additionally, yet another need exists for performing such modification so that pockets are still located on the outside of the vest, providing easy access for the hunter to the items inside.

OBJECTS OF THE INVENTION

Accordingly, it is the general object of the instant invention to provide a vest that is capable of being modified so that the color of the vest is changed without removing the vest.

It is a further object of the instant invention to provide for a vest that overcomes the shortcomings of previous vests and improves upon existing vest options for hunters.

It is yet a further object of the instant invention to provide a vest that can have its color modified easily and quickly by the hunter, without the need of having to store or carry extra clothing or colored fabric.

It is still yet a further object of the instant invention to provide for such a vest which can be modified without having to remove the vest or turn the vest over or inside out. This object of the invention prevents items stored in the pockets of the vest from shifting or spilling when such modification occurs.

It is still another object of the instant invention to provide a vest that can be modified so that the pockets of the vest remain on the outside of the vest. This object of the invention enables the hunter to always have easy access to items in the vest regardless of the color of the vest and prevents the hunter from having to switch items to different pockets.

DISCLOSURE OF THE INVENTION

The instant invention provides a vest which has colored reversible flaps on both the front and back of the vest. Both of the flaps have one side colored in camouflage while the other side is blaze orange in color. The blaze orange color is used in the subject invention to allow the hunter wearing the subject invention to be visible to other hunters. It should be readily appreciated that any bright color can be used in place of the blaze orange, although blaze orange is the color typically used by hunters. When the hunter wishes to change the color of the front side of the vest, the first flap is simply removed and flipped around to reveal the backside of the flap. This backside will be camouflage or blaze orange, depending on which side the hunter currently had visible. The hunter will now attach the front flap to the front side of the vest so that the new color is displayed. This modification is quick and easy. It does not require removal of the vest or storage of an item which accomplishes the same task as the colored flap. Further, if any items are located in the vest or on it, they are not disrupted during this modification. This is because only the flap, and not the vest, is removed and rotated.

The color of the back side of the vest is changed in a similar fashion. The second flap is attached to the back side of the vest. When the hunter wishes to change the color of the back of the vest, the hunter removes the second flap, flips the flap around, and attaches the second flap to the back of the vest. The hunter accomplishes this modification in the same way as the modification of the color of the front side of the vest.

BRIEF DESCRIPTION OF THE DRAWINGS

FIG. 5 is a front view of the game bag, contemplated for use as an additional embodiment of the subject invention.

BEST MODE FOR CARRYING OUT THE INVENTION

Figure 1:
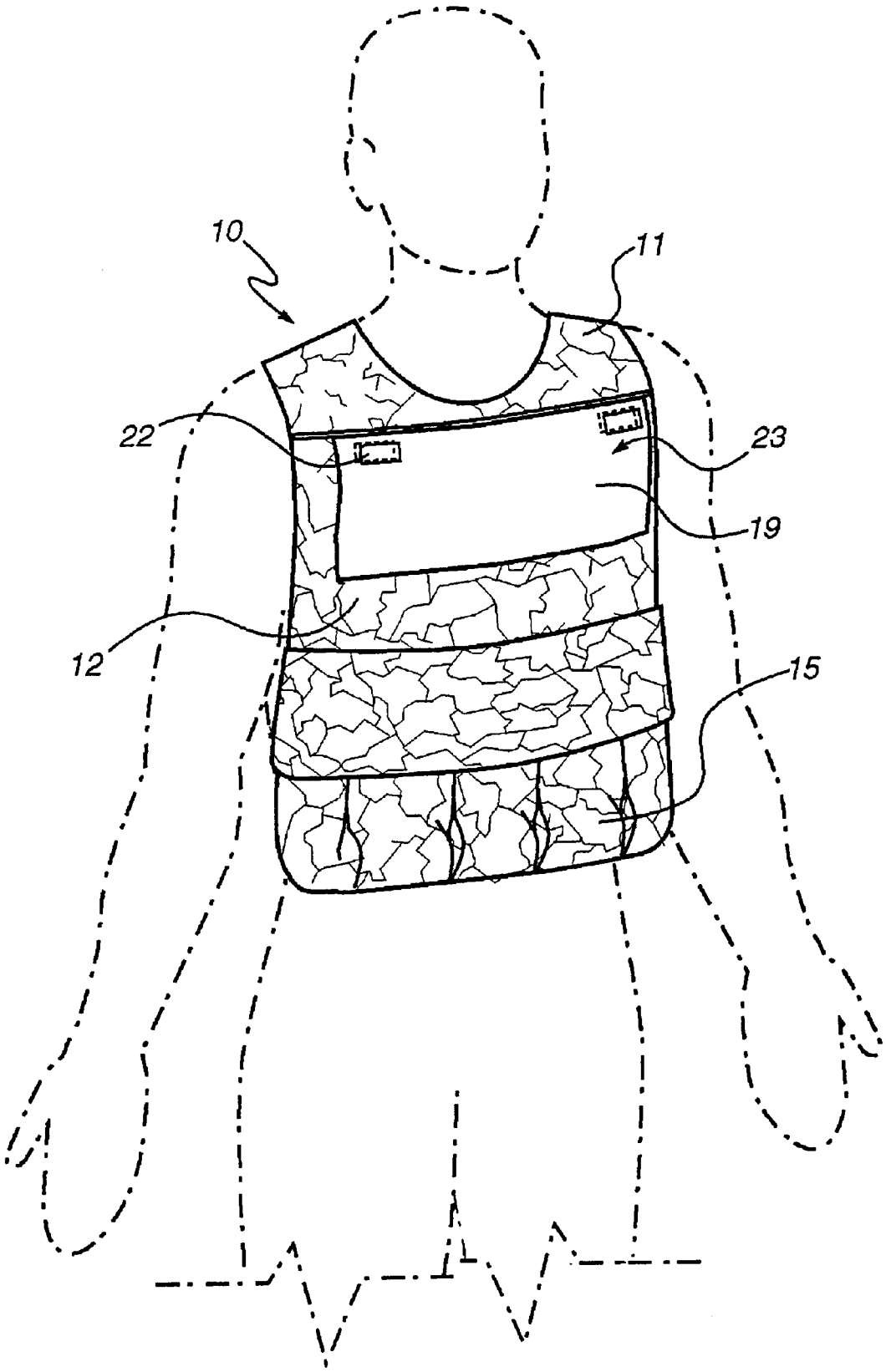
FIG. 1 is an front view of the vest of the subject invention, shown on a hunter.
Figure 2:
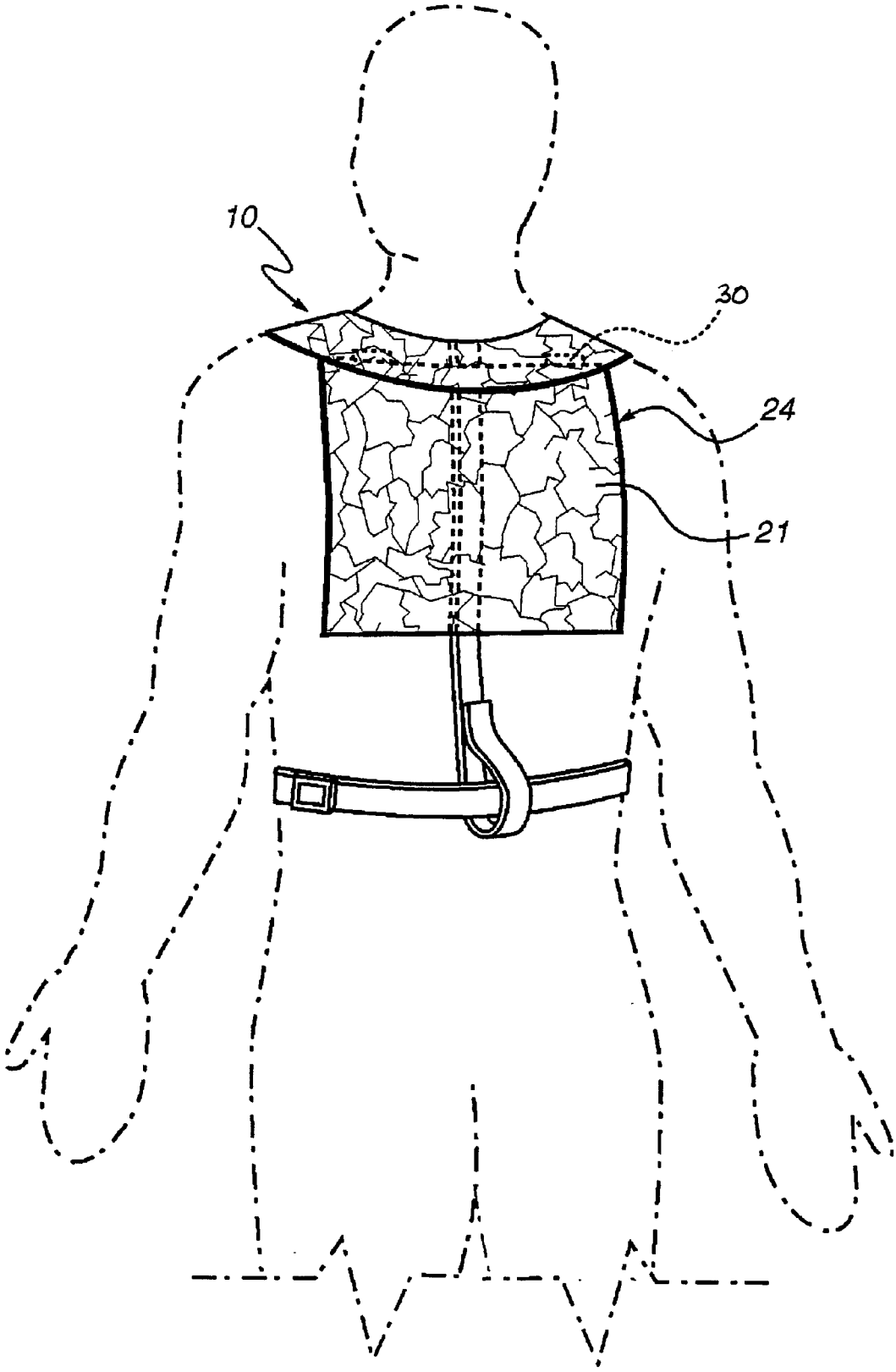
FIG. 2 is an back view of the vest of the subject invention, shown on a hunter.
Figure 3A:
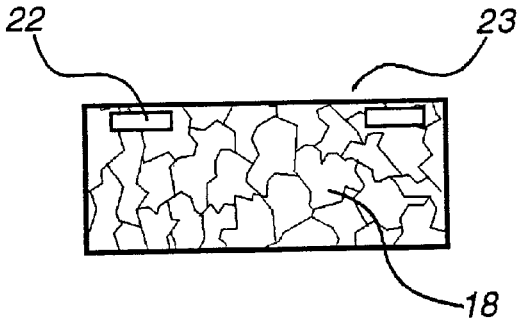
FIG. 3A is a view of the first colored side of the first flap that is camouflage in color.
Figure 3B:
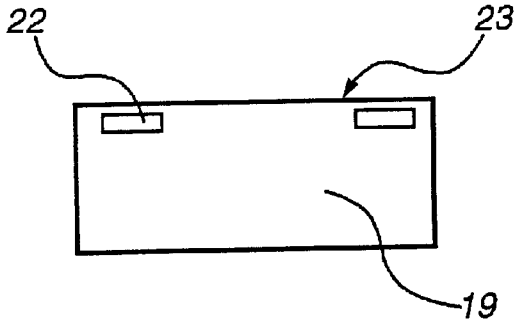
FIG. 3B is a view of the second colored side of the first flap that is blaze orange in color.
Figure 4A:
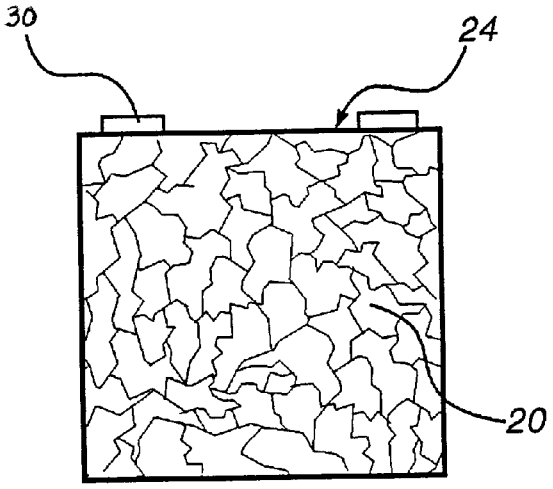
FIG. 4A is a view of the first colored side of the second flap that is camouflage in color.
Figure 4B:
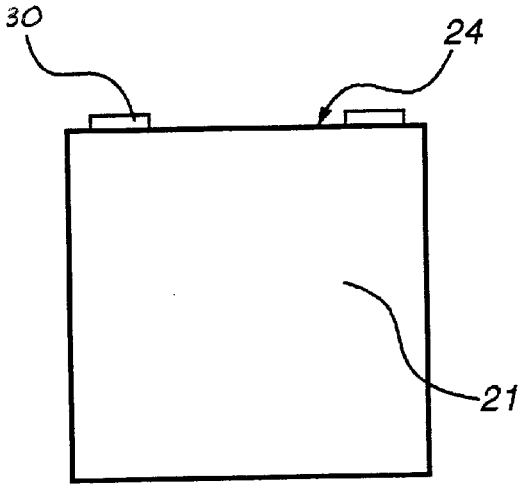
FIG. 4B is a view of the second colored side of the second flap that is blaze orange in color.

Referring now to the drawings, FIG. 1 shows a hunting vest 10 having reversible flaps in accordance with the present invention. The vest is composed of a base fabric material 11. The vest has a series of pockets 15 for holding shotgun shells. These pockets 15 are located near the bottom of front side 12 of the vest also has a second series of pockets 15. These pockets 15 are designed to store game calls, extra shells, and other hunting items. These pockets 15 are opened and closed by means of a flap with hook fasteners, commonly known as Velcro®. One skilled in the art should readily appreciate that any number of pockets can be placed anywhere on the vest.

First flap 23 attaches to the front side 12 of the vest 10. The first flap 23 has a front side 18 which is camouflage in color. The back side 19 of first flap 23 is blaze orange in color. Both front side 18 and back side 19 of first flap 23 have hook fasteners 22 attached. Hook fasteners 22 can be any type of fasteners that will allow the flaps to be easily removed and reattached, such as snaps or similar items well known in the art. The most preferred embodiment uses a material commonly known as Velcro® as the hook fasteners. Any number of hook fasteners may be used, so long as the flap is allowed to flop or turn. In the most preferred embodiment, the hook fastener is a strip of Velcro placed along the upper length of the flap. The blaze orange color is used in the subject invention to allow other hunters to readily recognize and identify the hunter wearing the subject invention. It should be readily appreciated that any bright color can be used in place of the blaze orange color, although blaze orange is the color typically used by hunters.

Second flap 24 is rectangular in shape and attaches to the back side 13 of vest 10. Second flap 24 has a front side 20 that is camouflage in color. The back side 21 of second flap 24 is blaze orange in color. Both front side 20 and back side 21 of second flap 24 have hook fasteners 30 attached. Hook fasteners 30 can be any type of fasteners that will allow the flaps to be easily removed and reattached, such as snaps or similar items well known in the art. The most preferred embodiment uses a material commonly known as Velcro® as the hook fasteners. Any number of hook fasteners may be used, so long as the flap is allowed to flop or turn. In the most preferred embodiment, the hook fastener is a strip of Velcro that runs along the upper length of the flap. The blaze orange color is used in the subject invention to allow other hunters to readily recognize and identify the hunter wearing the subject invention. It should be readily appreciated that any bright color can be used in place of the blaze orange color, although blaze orange is the color typically used by hunters.

The front side 12 of vest 10 has attachment points corresponding to the number of hook fasteners 22. The hook fasteners 22 of first flap 23 are secured to these attachment points. The user can secure either side of first flap 23 to these attachment points, thereby making the color of the vest 10 changeable. First flap 23 is designed to cover the first series of pockets 15 in order to ensure protection of the shotgun shells from the environment.

The back side 13 of vest 10 has attachment points corresponding to the number of hook fasteners 30. The hook fasteners 30 of second flap 24 are secured to these attachment points. The user can secure either side of second flap 24 to these attachment points, thereby making the color of the vest 10 changeable.

Figure 6:
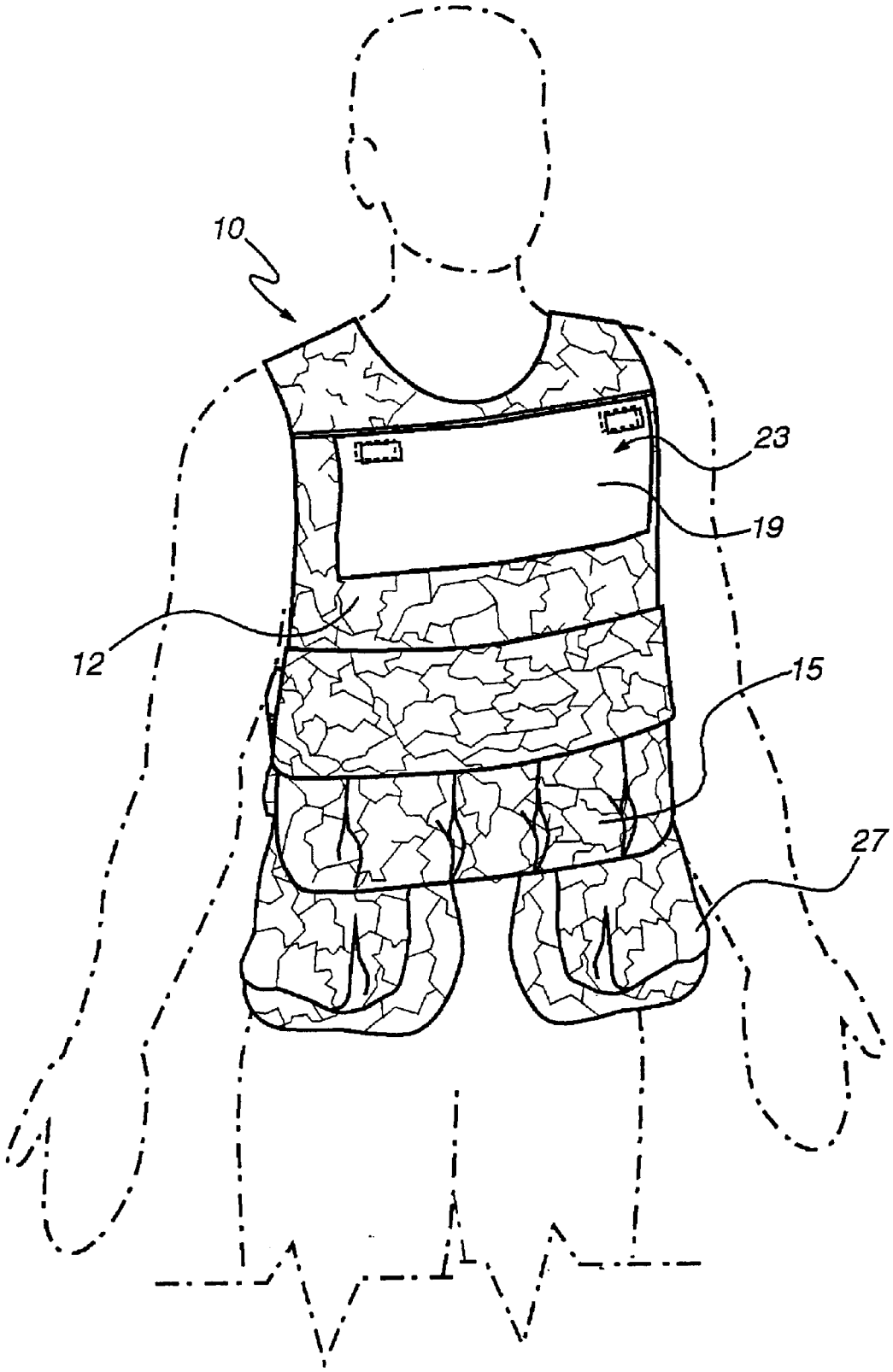
FIG. 6 is a front view of the vest of this invention incorporating a game bag.

Another embodiment of the present invention contemplates the use of a game bag 27 shown in FIG. 5. The game bag is separate garment that can be worn underneath the subject invention. The subject invention can be attached to the game bag through various attachment methods, thus allowing for the game bag 27 to become an integral part of vest 10, as shown in FIG. 6.

It will be appreciated that various modifications and changes may be made to the above described best mode of the invention without departing from the spirit or scope of the following claims.

I claim:

1. A vest comprising:

(a) a base fabric material having a front side wherein said front side covers a chest of a human torso and a back side wherein said back side covers a back of a human torso;

(b) a first flap having a first colored side wherein said first colored side is colored camouflage and having a second colored side wherein said second colored side is colored blaze orange, both said first colored side of said first flap and said second colored side of said first flap being removably attached to said front side of said base fabric material;

(c) a second flap having a first colored side wherein said first colored side is colored camouflage and having a second colored side wherein said second colored side is colored blaze orange, both said first colored side of said second flap and said second colored side of said second flap being removably attached to said back side of said base fabric material; and (d) a holder for shotgun shells located on said front side of said base fabric material and covered by said first flap.

2. The vest of claim 1 further comprising a series of not less than three pockets located along an end of said base fabric material and covered by said first flap.

3. The vest of claim 1 further comprising a game bag having a plurality of adjustable straps detachably secured to said game bag and operatively arranged such that said game bag lies on a front of a human torso and is covered by said front side of said base fabric.

* * * * *